US011486026B2

(12) United States Patent
Von Kruger et al.

(10) Patent No.: US 11,486,026 B2
(45) Date of Patent: Nov. 1, 2022

(54) CALCIUM, ALUMINUM AND SILICON ALLOY, AS WELL AS A PROCESS FOR THE PRODUCTION OF THE SAME

(71) Applicant: BOZEL BRASIL SA, Sao Joao Del Rei (BR)

(72) Inventors: Paulo Von Kruger, Belo Horizonte (BR); Lupercio Tarcisio De Oliveira, Belo Horizonte (BR); Wilson Alves Lage, Sao Joao Del Rei (BR); Francisco Xavier Da Silva Neto, Sao Joao Del Rei (BR)

(73) Assignee: BOZEL BRASIL SA, Sao Joao del Rei (BR)

( * ) Notice: Subject to any disclaimer, the term of this patent is extended or adjusted under 35 U.S.C. 154(b) by 0 days.

(21) Appl. No.: 17/253,718

(22) PCT Filed: Jul. 3, 2019

(86) PCT No.: PCT/US2019/040519
§ 371 (c)(1),
(2) Date: Dec. 18, 2020

(87) PCT Pub. No.: WO2020/010209
PCT Pub. Date: Jan. 9, 2020

(65) Prior Publication Data

US 2021/0262067 A1 Aug. 26, 2021

(30) Foreign Application Priority Data

Jul. 3, 2018 (BR) ..... 1020180136445

(51) Int. Cl.

| | |
|---|---|
| ***C22C 30/00*** | (2006.01) |
| ***C21C 7/06*** | (2006.01) |
| ***C22B 5/04*** | (2006.01) |
| ***C22B 5/10*** | (2006.01) |
| ***C22C 21/02*** | (2006.01) |
| ***C22C 24/00*** | (2006.01) |

(52) U.S. Cl.
CPC ..... *C22C 30/00* (2013.01); *C21C 7/06* (2013.01); *C22B 5/04* (2013.01); *C22B 5/10* (2013.01); *C22C 21/02* (2013.01); *C22C 24/00* (2013.01)

(58) Field of Classification Search
CPC ..... C22C 30/00; C22C 21/02; C22C 21/00; C22C 24/00; C21C 7/06; C22B 5/04; C22B 5/10
See application file for complete search history.

(56) References Cited

U.S. PATENT DOCUMENTS

| | | | |
|---|---|---|---|
| 1,512,462 | A | 10/1924 | Hagland |
| 2,767,084 | A | 10/1956 | Chandler |
| 3,649,253 | A | 3/1972 | Kaess |
| 8,409,470 | B2 | 4/2013 | Hirosaki et al. |

FOREIGN PATENT DOCUMENTS

| | | | |
|---|---|---|---|
| CN | 1243883 | A | 2/2000 |
| CN | 1074048 | | 10/2001 |
| CN | 101336209 | A | 12/2008 |
| CN | 101775493 | A | 7/2010 |
| CN | 101775493 | B | 7/2012 |
| DE | 1289660 | B | 2/1969 |
| DE | 2022077 | A1 | 3/1972 |
| EP | 0058922 | | 9/1982 |
| FR | 2445385 | A1 | 7/1980 |
| GB | 897326 | A | 5/1962 |
| JP | 58006945 | A | 1/1983 |

OTHER PUBLICATIONS

Office Action for corresponding China Application No. 2019800440695 dated Dec. 3, 2021 with English translation (12 pages).
International Search Report and Written Opinion (ISA/US) for PCT/US2019/040519 dated Sep. 20, 2019 (11 pages).
Extended European Search Report (EESR) for EP Application No. 19830717 dated Feb. 22, 2022 (2 pages).
International Search Report and Written Opinion (ISA/US) for PCT/US2019/040514 dated Sep. 24, 2019 (14 pages).
Office Action for Japanese Application No. 2021-522938 dated Mar. 11, 2022 (5 pages).
Extended European Search Report for EP Application No. 19830716.7 dated Jul. 1, 2022 (6 pages).
Office Action for Chinese Application No. 201980044069.5 dated May 20, 2022, 10 pages.
Office Action for India Patent Application No. 202117000761 dated Aug. 23, 2022 (7 pages).

*Primary Examiner* — Jessee R Roe
(74) *Attorney, Agent, or Firm* — Alston & Bird LLP

(57) ABSTRACT

A process for the production of calcium, aluminum, and silicon alloys is provided. The process includes the simultaneous carbothermal melting-reduction step of calcium, aluminum, and silicon.

20 Claims, No Drawings

CALCIUM, ALUMINUM AND SILICON ALLOY, AS WELL AS A PROCESS FOR THE PRODUCTION OF THE SAME

CROSS-REFERENCE TO RELATED APPLICATIONS

The present application is a national phase entry of PCT/US2019/040519, filed on Jul. 3, 2019, which claims the benefit of priority of Brazilian Patent Application No. BR 10 2018 013644 5 filed on Jul. 3, 2018, the contents of which are incorporated herein by reference in their entirety for all purposes.

Technical Field

The products and processes described below can be applied in the steel industry, more specifically in the production of steels and other alloys.

Background

The steel production process can be summarized in two basic steps: alloy formation and refining thereof, which are carried out in succession. The steel is formed by the addition of various metal alloys and is then refined by various techniques.

The refining step may include desulfurization, modification and removal of nonmetallic inclusions, such as globular inclusions, in addition to degassing, i.e. reduction of the oxygen, nitrogen and hydrogen content.

The desulphurization and modification and removal of non-metallic inclusions are fundamental for obtaining a quality steel, since inclusions can affect the mechanical characteristics of the product. Nonmetallic inclusions are impurities present in steels that alter their properties to a greater or lesser degree, depending on the quantity, size, morphology and chemical composition of the same. In the majority they can be considered deleterious to the product. For example, inclusions of iron sulfide (FeS) have a very low melting point, relative to that of steel (FeS melts at around 1000° C.), so that their presence in the processes of hot mechanical forming, carried out usually above 1000° C., gives the steel the so-called "hot brittleness".

For these reasons, the steel industry has sought to reduce and control the level of non-metallic inclusions in steels in order to produce "cleaner steels" and consequently more homogeneous and with better mechanical properties.

Non-metallic inclusions, in general, originate from reactions during the manufacturing process, from precipitation during cooling or are also the result of mechanical incorporation of materials with which the liquid steel comes in contact. These inclusions may be modified morphologically or eliminated by treatment with calcium, silicon and aluminum alloys, for example.

Metal alloys used in steel refining comprising calcium, silicon and aluminum are widely known in the art and are produced and commercialized on a large scale by dozens of manufacturers and suppliers around the world.

Such alloys include, for example, calcium-silicon (CaSi), iron-sodium-manganese (FeSiMn) and calcium alum inate alloys, the former being a deoxidizer and morphological controller of inclusions, the latter a complex deoxidizer and third increases refining efficiency and has other possible uses.

Although the aforementioned existing alloys are relatively useful in their respective purposes, for example, for the elimination of non-metallic inclusions, deoxidation and desulphurization of steel in intermediate stages of production, there is a need to develop new cheaper and more efficient products that meet better the production requirements of steels, for example with higher quality, better physical properties and durability, as well as improved processes for obtaining them.

Based on the above, it can be deduced that a Calcium-Silicon-Aluminum alloy is, in theory, a highly efficient deoxidizer because it counts on the simultaneous action of silicon and aluminum, with a high utilization of calcium in the control of inclusions, for example.

However, in the case of a purely physical mixture of Ca, Al and Si, each element has an independent behavior per se. Thus, in the environment of an oxidized steel bath, the preferential deoxidation reaction will be that with the most reactive element.

Thus, in the case of a physical mixture of Ca, Al and Si, the main deoxidizer would be calcium, which deviates it from its main purpose, which is the control of inclusions. Furthermore, since the components are isolated, the respective equilibrium points will be reached prematurely, reducing the extent of the desired reactions.

SUMMARY

In the attempt to develop a new metal alloy that meets market needs and overcome the shortcomings cited above, the inventors have found that steel refining results using Ca, Al and Si alloys are optimized when the Ca, Al, and Si elements of the alloys are chemically interconnected, in relation to alloys in which the elements are physically connected.

The calcium, aluminum and silicon alloy (CaAlSi) described and claimed below is formed by the chemical bonding between these three elements and as a result is an excellent deoxidizer because of the synergistic effect of the combined action of aluminum and silicon, which preserve the calcium when chemically bound thereto, leaving it fully available to act on the oxidation products (silicates and aluminates), transforming them into liquid globular inclusions, easily removable by flotation of the metal bath, for example.

In addition, extensive deoxidation and the presence of elemental calcium create an environment conducive to the removal of residual sulfur by means of calcium itself.

It can therefore be said that the inventors have found that there is a synergistic effect between calcium, aluminum and silicon for the modification and elimination of non-metallic inclusions during the steel refining when such elements are chemically bonded. This fact is explained by the thermodynamic conditions of the system. In fact, the simultaneous action of two or more components generating complex products is more extensive than that of each of the components acting alone.

Better explaining, deoxidation reactions by silicon and aluminum, i.e.:

$$Si+O_2 \rightarrow SiO_2$$

$$2Al+1.5O_2 \rightarrow Al_2O_3$$

they reach equilibrium, that is, they are less extensive than the simultaneous reaction of the two components, namely:

$$SiAl_2+2.5O_2 \rightarrow SiO_2.Al_2O_3$$

However, during the development of the CaAlSi alloys as proposed herein, where all three elements are chemically bonded, the inventors have encountered several difficulties. For example, the stability of Si, Al and Ca oxides is increasing in this order (Si<Al<Ca), so the tendency is for preferential reduction of Si at temperatures below those of reduction of the others, as well as Ca slagification and Al.

Moreover, the formation of carbides is preferential to the formation of molecules formed only by the elements Ca, Al or Si, precisely because of the excess of carbon not used in the reduction of Al and Ca. Thus, there will be formation of carbides until saturation. In the case of silicon carbide, this can cause the furnace to become crushed, since such a compound is refractory.

The process described and claimed herein has been developed in order to obtain the CaAlSi alloy with the improved features described above, at the same time eliminating the difficulties set forth above.

Therefore one of the objects of the product and process described and claimed herein is to provide a metal alloy of Ca, Al and Si where the elements C, Al and Si are chemically bonded.

It is also one of the objectives to provide an alloy of Ca, Al and Si that has a synergistic effect on the control of nonmetallic inclusions, deoxidation and desulfurization.

In addition, one of the objectives is to provide a metallic alloy with the same characteristics mentioned above and also comprising other elements such as Iron (Fe), Titanium (Ti), Manganese (Mn), among other metals.

It is another object of the process described herein and claimed to produce metal alloys as described above, comprising a simultaneous carbothermal melting-reduction step of the three metals from their sources.

DETAILED DESCRIPTION

Generally, the calcium (Ca), aluminum (Al) and silicon (Si) alloy or alloy CaAlSi herein described and claimed comprises approximately 15 to 45% Ca, 20 to 40% Al and 20 to 40%. These percentages may vary according to the purpose of the use of the alloy.

The inventors have found that there is a synergistic effect between calcium, aluminum and silicon for the modification and elimination of nonmetallic inclusions during the steel refining when such elements are chemically bonded. This fact is explained by the thermodynamic conditions of the system. In fact, the simultaneous action of two or more components generating complex products is more extensive than that of each of the components acting alone.

Better explaining, deoxidation reactions by silicon and aluminum, ie:

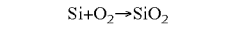

$$Si+O_2 \rightarrow SiO_2$$

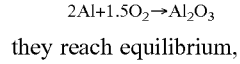

$$2Al+1.5O_2 \rightarrow Al_2O_3$$

they reach equilibrium, that is, they are less extensive than the simultaneous reaction of the two components, namely:

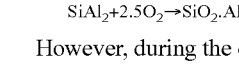

$$SiAl_2+2.5O_2 \rightarrow SiO_2.Al_2O_3$$

However, during the development of the CaAlSi alloys as proposed herein, where all three elements are chemically bonded, the inventors have encountered several difficulties. For example, the stability of Si, Al and Ca oxides is increasing in this order (Si<Al<Ca), so the tendency is for preferential reduction of Si at temperatures below those of reduction of the others, as well as Ca slagification and Al.

Moreover, the formation of carbides is preferential to the formation of molecules formed only by the elements Ca, Al or Si, precisely because of the excess of carbon not used in the reduction of Al and Ca. Thus, there will be formation of carbides until saturation. In the case of silicon carbide, this can cause the furnace to become crushed, since such a compound is refractory.

The process described and claimed herein has been developed in order to obtain the CaAlSi alloy with the improved features described above, at the same time eliminating the difficulties set forth above.

An alloy according to the above-mentioned objects may comprise about 40% Ca, 25% Al and 35% Si, or 25% Ca, 35% Al and 40% Si; or 33% Ca, 33% of Al and 33% of Si, or 35% of Ca, 20% of Al and 40% of Si, being the remainder of the composition complemented by other elements, for example.

In one embodiment, the elements Ca, Al and Si present in the alloy are chemically linked together. As explained above, such chemical bonding is beneficial because it leaves the Ca more available to, for example, participate in reactions that will facilitate the elimination of nonmetallic inclusions, as well as for sulfur removal, or desulfurization.

Therefore, in one embodiment, the claimed calcium (Ca), aluminum (Al) and silicon (Si) alloy has synergistic activity, since the same results would not be achieved by the isolated elements or by an alloy in which such elements are only physically connected.

This is explained by the fact that, regardless of the amount of alumina present, calcium will combine with all the available oxygen (as shown below), unless it combines with components with higher affinity:

Reaction of formation of inclusions of CaO—$Al_2O_3$:

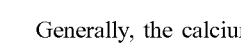

$$Ca+[O](diss)+Al_2O_3(incl) \rightarrow CaO.Al_2O_3$$

Considering that calcium is a more noble component, it is sought to add it together with competing agents, which are also technically and economically compatible, so that the consumption of Ca is limited to that necessary for the formation of the calcium aluminates.

Considered in isolation, silicon and aluminum would not, to a desired extent, play the role of calcium protectors against the action of surplus oxygen. Already, in the form of the inter-metallic compound Al—Si, they act as a "third element", with oxygen affinity superior to that of calcium.

In one embodiment, the Calcium sources used for the production of the alloy claimed herein may be, for example, virgin lime, hydrated lime, limestone and other calcium carbonates. Aluminum sources, for example, may be bauxites and aluminum silicates. In turn, the silicon sources may be, for example, quartz, quartzite and aluminum silicates.

Alternatively, in a possible embodiment, the sources of Ca, Al and Si may be, for example, slags, furnace filter powders and other Ca, Al and Si alloys.

In one embodiment, the alloy of Ca, Al and Si may comprise other elements, such as Iron (Fe), Titanium (Ti), Manganese (Mn), among other metals, in the proportion of to 10%.

In addition to the alloy of Calcium (Ca), Aluminum (Al) and Silicon (Si) claimed herein, a process for the production of calcium (Ca), aluminum (Al) and silicon (Si) alloy comprising a step simultaneous carbothermal melting-reduction of Calcium (Ca), Aluminum (Al) and Silicon (Si).

More precisely, in a possible embodiment, the process for producing calcium (Ca), Al (Al) and Silicon (Si) alloys comprises a simultaneous carbothermal melting-reduction step of a mixture of silicon, aluminum and calcium oxides.

In another possible modality, the process comprises the addition of minor proportions, Iron (Fe), Titanium (Ti), Manganese (Mn), among others, in the proportion of up to approximately 10%.

In one embodiment, the charges of the Ca, Al and Si sources used in the claimed process are chosen considering the thermodynamic activities of each source, limited to their respective stabilities, so that the energy available during the simultaneous carbothermal melting-reduction step is equally distributed among source reduction reactions. That is, the charges of the sources of Ca, Al and Si used in the claimed process are made in such a way as to allow the selective reduction of their sources.

More precisely, the charges of the Ca, Al and Si sources are made considering the thermodynamic activities of each source limited to their respective stabilities.

With regard to selective reduction, raw materials should be selected so that the metal reduction conditions are as close as possible. For example, sources of calcium must have as much free availability of CaO as possible.

The sources of aluminum are divided into two types: those that have free alumina and those that have complexed it.

Silicon sources are also divided into two types, as in the previous case, that is, those having free silica and those having complexed silica.

Objectively, the proportion of CaO in the load is predominant, in relation to the other components and its availability should be maximized (CaO free).

The proportion of $Al_2O_3$ in the charge is related to its availability (thermodynamic activity). This is adjusted using varying proportions of free alumina sources (such as bauxites) and complexed alumina (silicates, such as kaolin). This adjustment is made in such a way that the thermodynamic conditions of aluminum reduction are as close as possible to those of reducing the calcium.

The proportion of $SiO_2$ in the load obeys the same criteria as in the case of alumina. In this case the adjustment is made using varying proportions of free silica sources (such as quartz and quartzite) and complexed silica.

Considering the proportions referred to the availabilities, that is, to the activities of the respective oxides the proportions are decreasing in the direction Ca=>Al=>Si.

In one embodiment, the sources of Calcium, or calcium oxides, used for the production of the alloy claimed herein may be, for example, virgin lime, hydrated lime, limestone and other calcium carbonates. The sources of aluminum, or aluminum oxides, may be, for example, bauxites and aluminum silicates. In turn, the sources of silicon, or silicon oxides, may be, for example, quartz, quartzite and aluminum silicates. In addition to natural sources, others may be used, such as slag, silicon furnace filter powders and their alloys etc.

Another aspect considered in this development concerns the physicochemical characteristics of the slag formed in the formation of the alloy of Ca, Al and Si. As the reduction temperatures are high, the melting point of the slag must be above these for them to occur.

For reactions to occur efficiently, mobility/contact between species (Ca, Al, Si, etc.) is required, which implies a temperature above the melting point of the slag.

This implies the correct voltage-current relationship in the transformer secondary so that the position of the reaction zone and the energy concentration are adequate. This adjustment was made by means of preliminary theoretical evaluations and pilot test, as demonstrated in the examples.

With reference to the reducer, in the case of deficiency occurs the greater slagging of the load, and in case of excess the formation of carbides. With regard to the latter aspect, a large excess, in relation to the stoichiometry, leads to an incrustation of the furnace. However, a slight excess is desirable, since this carbide will contribute to adjust the melting point of the slag.

A possible reductant employed in the claimed process is coke, but it is also possible to employ charcoal, petroleum coke, coal or any other similar carbon source.

Finally, with regard to the preparation of the load, it is intended to make a mixture of the components as closely as possible so as to minimize the effect of preferential reactions. Thus, the particle size should be as small as possible, ensuring the permeability of the bed. Another possible preparation is by agglomerating the metal filler components (pellets, sinter, briquettes, among others) containing part or all of the reductant.

Examples

For the procedure adjustments, several loading alternatives were simulated, varying the raw materials, the formulations and the proportion of reducer. These alternatives were tested in an electric reduction furnace, on a pilot scale.

Ten test batteries were performed, from which adjustments were made based on the previous battery(s).

The methodology adopted for the tests was as follows.

The pilot furnace, single-phase, has a power of 50 kVA and adjustable crucible diameter between 15 cm and 30 cm.

Of course, to obtain the alloys calculated in those simulations, it is assumed that the operational and thermodynamic conditions are favorable.

From the operational point of view, the basic requirement is that the furnace has sufficient power to meet the thermal requirements of the system.

The basic thermodynamic conditions are the appropriate temperatures for the reduction reactions, the ratio between the activities of the oxides of the alloying elements, which should keep such proportions as to ensure a more homogeneous distribution of energy between the three major reduction reactions.

Based on these principles, the formulations were made in stage 1 and the operating conditions were established in each test.

A first action was to produce pellets with the mixture of the charge components containing the oxides of the alloying elements. The objective of this practice was to promote an intimate mixing between these components and ensure a good permeability of the load.

The reducer, in this case, metallurgical coke together with auxiliary components, in the case of iron ore and fluorite pellets, are charged together with the pellets.

In the following, the tests are described and commented.

Test #1

This first test is really the starting point, to establish the basic references, from which adjustments will be made.

The formulation chosen was a mixture of two types of bauxite, aiming to adjust Fe and Al, with sand, complementing the needs of Si and lime, as a source of calcium.

The proportion of reductant was stoichiometric, with the correction referring to the expected yields of the alloying elements.

The formulation of the load and the conditions of operation of the furnace are consolidated in the following.

| Test #1 | 20 Nov. 2017 | | | |
|---|---|---|---|---|
| Heating | 4 | hs | (08:00-12:00) | |
| Bed | | | Transformer | |
| Bauxite 225 | 50 | kg | Tap | 2 |
| Bauxite MPF | 20 | kg | V | 20 V |
| Sand | 30 | kg | I | 1500 A |
| Hydrated lime | 80 | kg | | |
| Dust from filters | 3 | kg | Crucible diameter | 30 cm |
| Total pellet | 183 | kg | | |
| Coke | 38 | kg | | |

Little melting. Sintered material

Before commenting on the test, a new component must be included: the dust from the BOZEL oven filter in São João Del Rey.

The initial objective was to use the reducer contained in this powder. However, because the generation is small relative to the intended production, their share of the low. There remains, however, a highly positive aspect, which is its total reuse.

Regarding furnace performance, there was little alloying and almost all of the filler did not melt to form a sintered mass containing small alloy spheres.

From this, it is clear that there was not enough energy for the melting of the charge and separation of the phases. The extent of the reduction reaction was also small, both due to the lack of mobility of the species and the relatively low temperature of the furnace.

Indeed, the predicted melt temperature for the slag is high, which is desirable to favor the reduction reactions. The diagram generated in the corresponding simulation (FIG. 1), shows this.

The recovered alloy was analyzed in X-ray Dispersive Energy Spectrometer-Coupled to SEM. The results are as follows.

| | |
|---|---|
| Si | 57.62 |
| Al | 18.7 |
| Ca | 12.02 |
| Fe | 9.86 |
| Mn | 0.44 |
| Ti | 0.59 |

An order of priority of the reduction reactions of the alloying elements is observed (of course, the reaction is preferential).

However, since there was no fusion of most of the charge, the results are positive signaling. In fact, there was a relatively high reduction for calcium, which suggests that under more favorable conditions this result should improve.

In order to increase the energy concentration, the diameter of the crucible was reduced from 30 cm to 20 cm in the second test.

Test #2

The same conditions of the previous test were maintained, as shown in the table below.

| Test #2 | 26 Nov. 2017 | | | |
|---|---|---|---|---|
| Heating | | hs | (08:00-12:00) | |
| Bed | | | Transformer | |
| Bauxite 225 | 50 | kg | Tap | 3 |
| Bauxite MPF | 20 | kg | V | 33 V |

-continued

| Test #2 | 26 Nov. 2017 | | | |
|---|---|---|---|---|
| Sand | 30 | kg | I | 1300 A |
| Hydrated lime | 80 | kg | | |
| Dust from filters | 3 | kg | Crucible diameter | 20 cm |
| Total pellet | 183 | kg | | |
| Coke | 36 | kg | | |

Note:
Oven boiled

Unfortunately, the oven boiled, damaging the test.

Test #3

In order to improve the slag conditions and the extent of the Al and Ca reduction reactions, fluorite was added to the filler and the proportion of coke was increased to three times the stoichiometric.

The data from this test are compiled in the following table.

| Test #3 | 30 Nov. 2017 | | | |
|---|---|---|---|---|
| Heating | | hs | (08:00-12:00) | |
| Bed | | | Transformer | |
| Bauxite 225 | 50 | kg | Tap | 3 |
| Bauxite MPF | 20 | kg | V | 33 V |
| Sand | 30 | kg | I | 1300 A |
| Hydrated lime | 80 | kg | | |
| Dust from filters | 3 | kg | Crucible diameter | 20 cm |
| Total pellet | 183 | kg | | |
| Fluorite | 7.32 | kg | | |
| Coke | 100 | kg | | |

Note:
Oven did not run and did not produce alloy

The oven did not run and did not produce alloy. The excess of carbon, without the counterpart of the energy supply led to the formation of carbides. There was no alloy production.

Test #4

Maintaining the basic mixture, the fluorite was removed and excess coke is maintained. On the operational side, the oven passed to tap 1, increasing the current and the diameter of the crucible was reduced to 15 cm, as shown in the table below.

| Test #4 | 4 Dec. 2017 | | | |
|---|---|---|---|---|
| Heating | | hs | (08:00-12:00) | |
| Bed | | | Transformer | |
| Bauxite 225 | 50 | kg | Tap | 1 |
| Bauxite MPF | 20 | kg | V | 19 V |
| Sand | 30 | kg | I | 2300 A |
| Hydrated lime | 80 | kg | | |
| Dust from filters | 3 | kg | Crucible diameter | 15 cm |
| Total pellet | 183 | kg | | |
| Fluorite | 0 | kg | | |
| Coke | 100 | kg | | |

Note:
Oven was not poured - just a little alloy and lots of slag

The alloy production was small, indicating the persistence of the problem of energy deficiency. The composition of the alloy was:

| | |
|---|---|
| Si | 53.01 |
| Al | 12.55 |
| Ca | 23.28 |
| Fe | 8.18 |
| Mn | 0.60 |
| Ti | 2.21 |

The results can be said to be comparable to those of Test #1. The oscillations can be attributed to the precarious conditions of the kiln progress.

Anyway, as in the previous case, the call sign is interesting.

Test #5 and Test #6

In tests #5 and #6 a 10% increase was made in the reducer, compared to the previous two and added iron ore, in the form of hematite pellets.

The objective of this procedure was to investigate the influence of the associated reduction of iron oxides on the extent of the reduction of the alloying elements.

The data from these two tests are compiled in the following two tables.

| Test #5 | 6 Dec. 2017 | | | |
|---|---|---|---|---|
| Heating | | hs | (08:00-12:00) | |
| Bed | | | Transformer | |
| Bauxite 225 | 50 | kg | Tap | 1 |
| Bauxite MPF | 20 | kg | V | 19 V |
| Sand | 30 | kg | I | 2300 A |
| Hydrated lime | 80 | kg | | |
| Dust from filters | 3 | kg | Crucible diameter | 15 cm |
| Total pellet | 183 | kg | | |
| Min pellets of Fe | 32 | kg | | |
| Fluorite | 0 | kg | | |
| Coke | 110 | kg | | |

Note:
195 g of alloy were poured. Electrode operating at upper limit

There was alloy leakage, below desirable, but compatible with the operating conditions.

The alloy produced has the following characteristics.

| | |
|---|---|
| Si | 35.96 |
| Al | 7.91 |
| Ca | 0.81 |
| Fe | 51.89 |
| Mn | 0.61 |
| Ti | 2.15 |

As can be observed, this alloy is similar to that of a ferrosilicon. Ca reduction was inhibited by competition from Fe.

With these results it was not possible to conclude on the effect of iron in the system.

In order to obtain more data, this test was repeated, as shown in the following table.

In this case, the furnace operated longer, producing two runs.

-continued

| Test #6 | 7 Dec. 2017 | | | |
|---|---|---|---|---|
| Heating | | hs | (08:00-12:00) | |
| Bed | | | Transformer | |
| Bauxite 225 | 50 | kg | Tap | 1 |
| Bauxite MPF | 20 | kg | V | 19 V |
| Sand | 30 | kg | I | 2300 A |
| Hydrated lime | 80 | kg | | |
| Dust from filters | 3 | kg | Crucible diameter | 15 cm |
| Total pellet | 183 | kg | | |
| Min pellets of Fe | 32 | kg | | |
| Fluorite | 0 | kg | | |
| Coke | 110 | kg | | |

Note:
There were two runs

The results of the two runs are shown below:

| | Run a | Run b |
|---|---|---|
| Si | 34.45 | 32.77 |
| Al | 19.83 | 12.84 |
| Ca | 4.72 | 1.53 |
| Fe | 36.17 | 50.43 |
| Mn | 0.61 | 0.76 |
| Ti | 2.66 | 1.34 |

It is observed a greater recovery of Al and Ca, the latter, however, very discrete.

Test #7

Considering the lack of objectivity of tests with iron with the conditions of the furnace, the load returned to the previous formulation, without the iron ore and without the 10% more coke. In this case, however, the electrical conditions were maintained, with the higher current.

The conditions of this test are compiled in the table below:

| Test #7 | 12 Dec. 2017 | | | |
|---|---|---|---|---|
| Heating | | hs | (08:00-12:00) | |
| Bed | | | Transformer | |
| Bauxite 225 | 50 | kg | Tap | 1 |
| Bauxite MPF | 20 | kg | V | 19 V |
| Sand | 30 | kg | I | 2300 A |
| Hydrated lime | 80 | kg | | |
| Dust from filters | 3 | kg | Crucible diameter | 15 cm |
| Kaolin | 0 | kg | | |
| Total pellet | 183 | kg | | |
| Fluorite | 0 | kg | | |
| Coke | 100 | kg | | |

Note:
Little alloy slag

The alloy generation was small, within the same previous standards. The composition of the alloy is shown below.

| | |
|---|---|
| Si | 41.7 |
| Al | 20.32 |
| Ca | 9.1 |
| Fe | 10.85 |
| Mn | 0.41 |
| Ti | 2.35 |

An increase in Ca and Al recovery is observed with the iron inhibitory effect.

Test #8

In this test, a new formulation was tested, replacing bauxites and sand with kaolin.

One of the objectives would be to decrease the activities of silica and alumina in the form of aluminum silicate and keeping CaO free.

The characteristics of the test are shown below:

| Test #8 | 15 Dec. 2017 | | | |
|---|---|---|---|---|
| Heating | | hs | (08:00-12:00) | |
| | | | Transformer | |
| Bed | | | ○ | |
| Bauxite 225 | 0 | kg | Tap | 1 |
| Bauxite MPF | 0 | kg | V | 19 V |
| Sand | | | I | 2300 A |
| Hydrated lime | 80 | kg | | |
| Dust from filters | 0 | kg | Crucible diameter | 15 cm |
| Kaolin | 100 | kg | | |
| Total pellet | 183 | kg | | |
| Fluorite | 0 | kg | | |
| Coke | 100 | kg | | |

Electrodes came out (T2) Primary current at the limit (150A) - 30' . Then tap 1. No alloy was poured - just a little slag.

The following analysis is the alloy collected at the bottom of the furnace.

| | |
|---|---|
| Si | 50.13 |
| Al | 1.1 |
| Ca | 0.47 |
| Fe | 37.23 |
| Mn | 2.76 |
| Ti | 6.74 |

This analysis is incompatible with the characteristics of the load components. The iron content suggests contamination of the sample, or the charge. Therefore it will not be considered.

A single comment is about the melting point of the slag, which is high above the furnace's resources to melt it.

Test #9

For this test a new formulation was made, in order to generate a more fuse slag. As too much reduction of the melting point of the slag and hence the temperature of the furnace would inhibit the reduction of the more stable oxides, the formulation was directed so that the melting point of the slag was around 1600° C.

In fact, this temperature is below ideal, but it is more compatible with furnace features.

When more potent furnaces are used in later stages, the melting temperatures of the slag will again be higher.

The data from this test is shown in the following table.

| Test #9 | 19 Dec. 2017 | | | |
|---|---|---|---|---|
| Heating | | hs | (08:00-12:00) | |
| Bed | | | Transformer | |
| Bauxite 225 | 55 | kg | Tap | 1 |
| Bauxite MPF | 0 | kg | V | 19 V |
| Sand | 8 | kg | I | 2300 A |
| Hydrated lime | 61 | kg | | |
| Dust from filters | 0 | kg | Crucible diameter | 15 cm |
| Kaolin | 61 | kg | | |
| Total pellet | 185 | kg | | |
| Fluorite | 0 | kg | | |
| Coke | 100 | kg | | |

Note:
Normal operation, yielding two runs. The first at 1 h and the second at about 40' (electrode at the end of the course)

This is the most regular test, although the charge fusion was still inhibited.

There were two races. The second was anticipated because the electrode arrived at the end of upper course.

The results of the analyses are shown below:

| | | |
|---|---|---|
| Si | 32.57 | 24.41 |
| Al | 35.16 | 28.3 |
| Ca | 14.14 | 3.42 |
| Fe | 11.06 | 41.67 |
| Mn | 0.82 | 0.93 |
| Ti | 4.14 | 0.43 |

The first run shows an interesting trend, which can be improved with better operating conditions.

The second run occurred prematurely, which resulted in a higher concentration of iron, which reduction is preferential. Therefore, this data is not representative.

Test #10

The data and results of the tenth battery, ending the final adjustments, are presented below.

| Test #10 Agglomerated metallic load on pellets | | | | |
|---|---|---|---|---|
| Heating | | hs | (08:00-12:00) | |
| Bed | | | Transformer | |
| Bauxite 225 | 55 | kg | Tap | 1 |
| Bauxite MPF | 0 | kg | V | 19 V |
| Sand | 8 | kg | I | 2300 A |
| Hydrated lime | 61 | kg | | |
| Dust from filters | 2 | kg | Crucible diameter | 15 cm |
| Kaolin | 61 | kg | | |
| Total pellet | 187 | kg | | |
| Fluorite | 0 | kg | | |
| Coke | Stoichiometric + 30% | | | |

Run:

| Element | Average concentration | | Standard deviation |
|---|---|---|---|
| Mg | 0.78 | ± | 0.07 |
| Al | 30.33 | ± | 0.16 |
| Si | 32.09 | ± | 0.18 |
| S | 0.66 | ± | 0.07 |
| K | 0.16 | ± | 0.05 |
| Ca | 33.10 | ± | 0.17 |
| Ti | 0.20 | ± | 0.05 |
| Mn | 0.08 | ± | 0.05 |
| Fe | 0.20 | ± | 0.05 |
| Cu | 0.06 | ± | 0.06 |
| Zn | 0.07 | ± | 0.06 |
| Sb | 2.25 | 0.04 | 0.29 |
| Total: | 99.98 | | |

The invention claimed is:

1. A process for the production of a calcium, aluminum, and silicon alloy, wherein the process comprises a simultaneous carbothermal melting-reduction step of calcium, aluminum, and silicon, using one or more of quartz, quartzite, or aluminum silicates as a silicon source, wherein the alloy comprises from about 15 to about 45 wt % calcium, from about 20 to about 40 wt % aluminum, from about 20 to about 40 wt % silicon, from 0 to about 10 wt % iron, from 0 to about 10 wt % manganese, and from 0 to about 10 wt % titanium, and wherein a sum total content of iron, manganese, and titanium in the alloy is less than about 10 wt %.

2. The process according to claim 1, wherein the process comprises a simultaneous carbothermic melting-reduction step of a mixture of silicon, aluminum, and calcium oxides.

3. The process according to claim 1 wherein the process uses one or more of virgin lime, hydrated lime, limestone, or other calcium carbonates as a calcium source.

4. The process according to claim 1 wherein the process uses one or more of bauxites or aluminum silicates as an aluminum source.

5. The process according to claim 1 wherein available energy during the simultaneous carbothermic melting-reduction step is approximately evenly distributed between each of the reduction reactions of the sources of calcium, aluminum, and silicon, such that the alloy comprises about the same amounts of calcium, aluminum, and silicon.

6. The process according to claim 1 wherein selection of charges of calcium, aluminum, and silicon sources used in the process are based on the thermodynamic activities of each source, limited to their respective stabilities.

7. The process according to claim 1, wherein the alloy comprises less than 1 wt % iron.

8. The process according to claim 1, wherein the alloy comprises less than 1 wt % titanium.

9. The process according to claim 1, wherein the alloy comprises less than 1 wt % manganese.

10. The process according to claim 1, wherein the alloy comprises about the same amounts of calcium, aluminum, and silicon.

11. The process according to claim 1, wherein iron is present as an impurity in one or more of a calcium source, an aluminum source, the silicon source, or a carbon source of the process.

12. The process according to claim 1, wherein titanium is present as an impurity in one or more of a calcium source, an aluminum source, the silicon source, or a carbon source of the process.

13. The process according to claim 1, wherein manganese is present as an impurity in one or more of a calcium source, an aluminum source, the silicon source, or a carbon source of the process.

14. A process for the production of a calcium, aluminum, and silicon alloy, wherein the process comprises a simultaneous carbothermal melting-reduction step of calcium, aluminum, and silicon, using one or more of quartz, quartzite, or aluminum silicates as a silicon source.

15. The process according to claim 14, wherein the alloy comprises from about 15 to about 45 wt % calcium, from about 20 to about 40 wt % aluminum, and from about 20 to about 40 wt % silicon.

16. The process according to claim 14, wherein the simultaneous carbothermal melting-reduction step uses a mixture of silicon, aluminum, and calcium oxides.

17. The process according to claim 14, wherein the process uses one or more of virgin lime, hydrated lime, limestone, or other calcium carbonates as a calcium source.

18. The process according to claim 14, wherein the process uses one or more of bauxites or aluminum silicates as an aluminum source.

19. The process according to claim 14, wherein available energy during the simultaneous carbothermic melting-reduction step is approximately evenly distributed between each of the reduction reactions of the sources of calcium, aluminum, and silicon, such that the alloy comprises about the same amounts of calcium, aluminum, and silicon.

20. The process according to claim 14, wherein selection of charges of calcium, aluminum, and silicon sources used in the process are based on the thermodynamic activities of each source, limited to their respective stabilities.

* * * * *